US011498724B1

(12) United States Patent
Christian, Sr.

(10) Patent No.: US 11,498,724 B1
(45) Date of Patent: Nov. 15, 2022

(54) SYSTEM AND METHOD FOR SELF RELEASING CHAMPAGNE CORK

(71) Applicant: Michael B. Christian, Sr., Elon, NC (US)

(72) Inventor: Michael B. Christian, Sr., Elon, NC (US)

( * ) Notice: Subject to any disclaimer, the term of this patent is extended or adjusted under 35 U.S.C. 154(b) by 0 days.

(21) Appl. No.: 17/405,986

(22) Filed: Aug. 18, 2021

(51) Int. Cl.

| | |
|---|---|
| ***B65D 39/12*** | (2006.01) |
| ***B65D 39/00*** | (2006.01) |
| ***B67B 7/06*** | (2006.01) |
| ***B67B 1/04*** | (2006.01) |
| ***G08C 17/02*** | (2006.01) |

(52) U.S. Cl.
CPC ..... *B65D 39/12* (2013.01); *B65D 39/0064* (2013.01); *B67B 1/04* (2013.01); *B67B 7/066* (2013.01); *G08C 17/02* (2013.01); *G08C 2201/30* (2013.01)

(58) Field of Classification Search
CPC ..... B65D 39/12; B65D 39/16; B65D 39/007; B65D 39/0017; B65D 39/0058; B65D 39/0064; B65D 2539/003; B65D 81/245; B65D 55/063; B65D 51/1683; B67B 7/06; B67B 7/066; B67B 7/08; B67B 1/00; B67B 1/04; B67B 2007/0458
USPC ..... 220/232, 720, 800–801, 212, 578, 787, 220/789, DIG. 19; 215/364, 269, 355, 215/228, 231, 296, 358; 222/544–574, 222/399; 81/3.2, 3.48–3.49, 3.08, 81/3.36–3.37, 3.29; 141/329
See application file for complete search history.

(56) References Cited

U.S. PATENT DOCUMENTS

| | | | | | |
|---|---|---|---|---|---|
| 447,974 | A * | 3/1891 | Rheinstrom | B65D 39/12 | 215/269 |
| 759,496 | A * | 5/1904 | Baker | B65D 49/04 | 215/21 |
| 773,345 | A | 10/1904 | Scheidt | | |
| 908,822 | A * | 1/1909 | Turner | B65D 41/3442 | 215/258 |
| 978,712 | A * | 12/1910 | Drenk | B65D 55/02 | 215/250 |
| 1,416,278 | A * | 5/1922 | Furman | B65D 39/12 | 215/360 |
| 1,923,091 | A * | 8/1933 | Hoffman | B65D 41/62 | 215/251 |

(Continued)

FOREIGN PATENT DOCUMENTS

| | | | | |
|---|---|---|---|---|
| FR | 2903671 A1 * | 1/2008 | B65D 39/12 | |
| WO | WO-0013984 A1 * | 3/2000 | B65D 39/00 | |
| WO | WO-2015101818 A1 * | 7/2015 | B65D 39/12 | |

*Primary Examiner* — Chun Hoi Cheung
*Assistant Examiner* — Brijesh V. Patel
(74) *Attorney, Agent, or Firm* — Christopher Mayle; Bold IP, PLLC

(57) ABSTRACT

A system and method for easily operated self-releasing stopper/cork for bottles of compressed liquids. The corks have a gas bladder that is designed to be inserted in a bottle and inflated, the bladder having a ribbed or smooth exterior to complete the sealing of the bottle whereby a gas release mechanism can be activated by depressing a button on a cap or via an on-board micro controller and/or electro-mechanical release solution in the cap. Once the gas is released from the bladder the pressure inside the vessel will collapse the bladder's bottom and eject the cork assembly from the bottle.

4 Claims, 7 Drawing Sheets

(56) References Cited

U.S. PATENT DOCUMENTS 2,115,035 A * 4/1938 Morgan ..... B65D 39/12 215/358
2,196,785 A * 4/1940 Takiguchi ..... B65D 39/007 215/355
2,786,594 A * 3/1957 Rigolot ..... B65D 41/023 215/320
2,921,708 A * 1/1960 Marcel ..... B65D 39/0029 215/230
2,940,627 A * 6/1960 Schultz ..... B65D 39/0017 215/250
3,128,896 A * 4/1964 Schnier ..... B65D 55/063 215/364
3,135,410 A 6/1964 Federighi
3,180,515 A * 4/1965 Lindgren ..... B65D 39/12 215/269
3,235,117 A 2/1966 Mason, Jr.
3,343,701 A * 9/1967 Mahoney ..... B67D 1/045 215/231
3,557,986 A * 1/1971 Poole, Jr. ..... B65B 31/047 215/228
3,836,035 A * 9/1974 Simbirdi ..... B65D 39/12 220/235
3,900,124 A * 8/1975 Marcel ..... B65D 39/04 215/291
3,994,409 A 11/1976 Nightengale, Jr.
4,076,142 A 2/1978 Naz
4,091,136 A 5/1978 O'Brien et al.
4,098,422 A * 7/1978 Slomski ..... B65D 39/0017 215/320
4,363,416 A * 12/1982 Loughmiller ..... B65D 39/0064 215/364
4,364,486 A 12/1982 Korte et al.
4,392,578 A * 7/1983 Fipp ..... B65D 81/2076 215/231
4,394,921 A 7/1983 Miskinis
4,401,226 A * 8/1983 Brown ..... B65D 51/1683 215/250
4,473,174 A * 9/1984 Heuser ..... B67D 1/0885 215/311
4,474,302 A 10/1984 Goldberg et al.
4,480,424 A * 11/1984 Seldon ..... B65D 39/12 215/269
4,482,072 A * 11/1984 Hankins ..... B65B 31/047 215/231
4,621,743 A * 11/1986 DiRegolo ..... B65D 47/06 215/308
4,867,209 A * 9/1989 Santoiemmo ..... B01F 23/23611 261/DIG. 7
4,889,251 A 12/1989 Hojnoski
4,978,538 A * 12/1990 Gladstone ..... C12G 1/08 426/15
5,405,033 A * 4/1995 Sweed ..... B65D 41/22 215/271
5,535,900 A * 7/1996 Huang ..... B65B 31/047 137/522
5,651,940 A * 7/1997 Buonaiuto ..... B01L 3/50825 422/570
5,722,548 A 3/1998 Hojnoski
5,779,085 A 7/1998 Havlinek et al.
6,168,036 B1 1/2001 Teng
6,260,474 B1 * 7/2001 Yahav ..... B65D 51/24 211/77
6,499,618 B1 * 12/2002 Leclerc ..... B65D 39/00 215/291
6,622,595 B1 * 9/2003 Federighi ..... B67B 7/08 7/155
7,051,901 B2 * 5/2006 Hickert ..... B65D 81/245 222/1
7,234,375 B1 * 6/2007 Wang Wu ..... B67B 7/08 81/3.2
7,395,942 B2 * 7/2008 Michalopoulos .. B65D 81/2038 141/114
7,726,356 B2 * 6/2010 van der Lande ..... B65B 31/047 141/65
D639,657 S * 6/2011 Hoyt ..... D9/439
8,020,833 B2 * 9/2011 Sun ..... A62C 35/02 251/30.01
8,573,422 B1 * 11/2013 Dillon ..... B65D 55/063 215/45
8,662,342 B1 * 3/2014 DeTolla ..... B65D 81/245 220/578
8,701,910 B1 * 4/2014 Michalopoulos .. B65D 81/2038 215/311
8,714,383 B2 * 5/2014 Corson ..... B65D 39/0088 215/364
8,783,486 B1 * 7/2014 Hoyt ..... B65D 39/12 215/269
8,820,551 B2 * 9/2014 Arney ..... B65D 39/12 215/269
8,910,818 B2 * 12/2014 Heiml ..... B01L 3/50825 220/287
9,452,875 B2 * 9/2016 Jepson ..... B65B 1/04
9,597,088 B2 * 3/2017 Ottma ..... A61B 17/0057
9,637,367 B1 5/2017 Arnold
10,000,320 B2 6/2018 Gagne
10,526,116 B1 1/2020 Dorra
2006/0124661 A1 * 6/2006 Siimes ..... F16K 15/18 222/3
2011/0030810 A1 * 2/2011 Shellcot ..... B67D 3/044 137/171
2014/0246396 A1 * 9/2014 Jepson ..... G06F 16/00 215/260
2015/0321894 A1 * 11/2015 Rasmussen ..... B65B 1/00 222/82
2016/0377203 A1 * 12/2016 Norman ..... A61M 39/12 285/382.7
2017/0129664 A1 * 5/2017 Hatamian ..... B65D 39/12
2017/0129758 A1 * 5/2017 Hume ..... B67B 7/08
2017/0275057 A1 9/2017 Valencia et al.
2017/0283124 A1 10/2017 Willson
2018/0029861 A1 2/2018 Tornesch et al.
2018/0037363 A1 2/2018 Frishman

* cited by examiner

SYSTEM AND METHOD FOR SELF RELEASING CHAMPAGNE CORK

FIELD OF DISCLOSURE

The overall invention relates generally to a bottle stopper, and more particularly to a self-releasing stopper for a bottle of pressurized liquid containing sparkling beverage or champagne.

BACKGROUND

The consumption of sparkling beverages, prosecco, and champagne are usually performed during celebrations. These celebrations are timed to a specific moment due to the challenges with releasing the cork or stopper. The cork may or may not release when desired. Additionally, the stopper may eject at velocities over 100 mph. The high velocity and untimed release can lead to the tragedy of a lost opportunity or injury to a participant of the celebration. The present shape of champagne corks makes removal of the cork challenging for timed and safe extraction. In addition, the dart-like shape can act as a projectile that will fly at a continuous high velocity when released. This firm bell shape of the cork maintains full gas pressure on the bottom of the cork throughout the removal process there by instilling maximum force velocity.

SUMMARY

The present invention is directed to embodiments including a stopper for a neck of a bottle, the stopper including an inflatable bladder with an interior chamber, an inflation tube in fluid communication with the interior chamber, and a cap assembly positioned above the inflatable bladder, the cap assembly having a release mechanism to release gas from the inflatable bladder, whereby the release mechanism comprises a needle or blade to puncture the inflation tube, whereby the release mechanism comprises an actuator connected to the needle or blade whereby when the actuator moves from a first position to a second position, the needle or blade moves from a first position to a second position, whereby the actuator is a button, whereby the actuator is a pull string, rope, or chain, connected to the needle, or plug, or valve by a pull push mechanism, whereby the inflation tube has a valve, whereby the inflatable bladder has a v-shaped bottom with multiple segments angled upwards toward one another, whereby the inflatable bladder has a circular top whereby the inflatable bladder has one or more ribs or protrusions on an exterior of the bladder.

The present invention is directed also to embodiments including a stopper for a neck of a bottle, the stopper including an inflatable bladder with an interior chamber, an inflation tube in fluid communication with the interior chamber, and a cap assembly positioned above the inflatable bladder, the cap assembly having a release mechanism to release gas from the inflatable bladder, the release mechanism having an automatic electromechanical release mechanism, whereby the electromechanical release mechanism has a control system that sends signals to puncture the inflation tube, the stopper further including a remote computing device; connected to the control system over a network whereby a user interface is presented on the remote computing device to control one or more operations of the stopper, whereby the control system is configured to delay removing the stopper from the bottle based on received input from an adjustable timer component on the user interface, whereby the release mechanism comprises a needle or blade to puncture the inflation tube, whereby the inflation tube has a valve, whereby the inflatable bladder has v shaped bottom with multiple segments angled upwards toward one another, whereby the inflatable bladder has a circular top, whereby the inflatable bladder has one or more ribs or protrusions on an exterior of the bladder.

The present invention is directed to embodiments including a method for a stopper in a neck of a bottle, the stopper having a bladder with an interior chamber, an inflation tube in fluid communication with the interior chamber, the method including inserting the bladder into the neck of the bottle, inflating the bladder with gas, affixing a cap assembly positioned above the bladder, the cap assembly having a release mechanism to release gas from the bladder, activating an actuator, puncturing the inflation tube thereby releasing the gas from the bladder whereby the bladder will be compressed out of the bottle by pressure placed on a conical bottom of the bladder, connecting to a remote computing device to control one or more operations of the stopper, receiving input from an adjustable timer component on a user interface of the remote computing device, and controlling a timed release of the stopper from the bottle.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
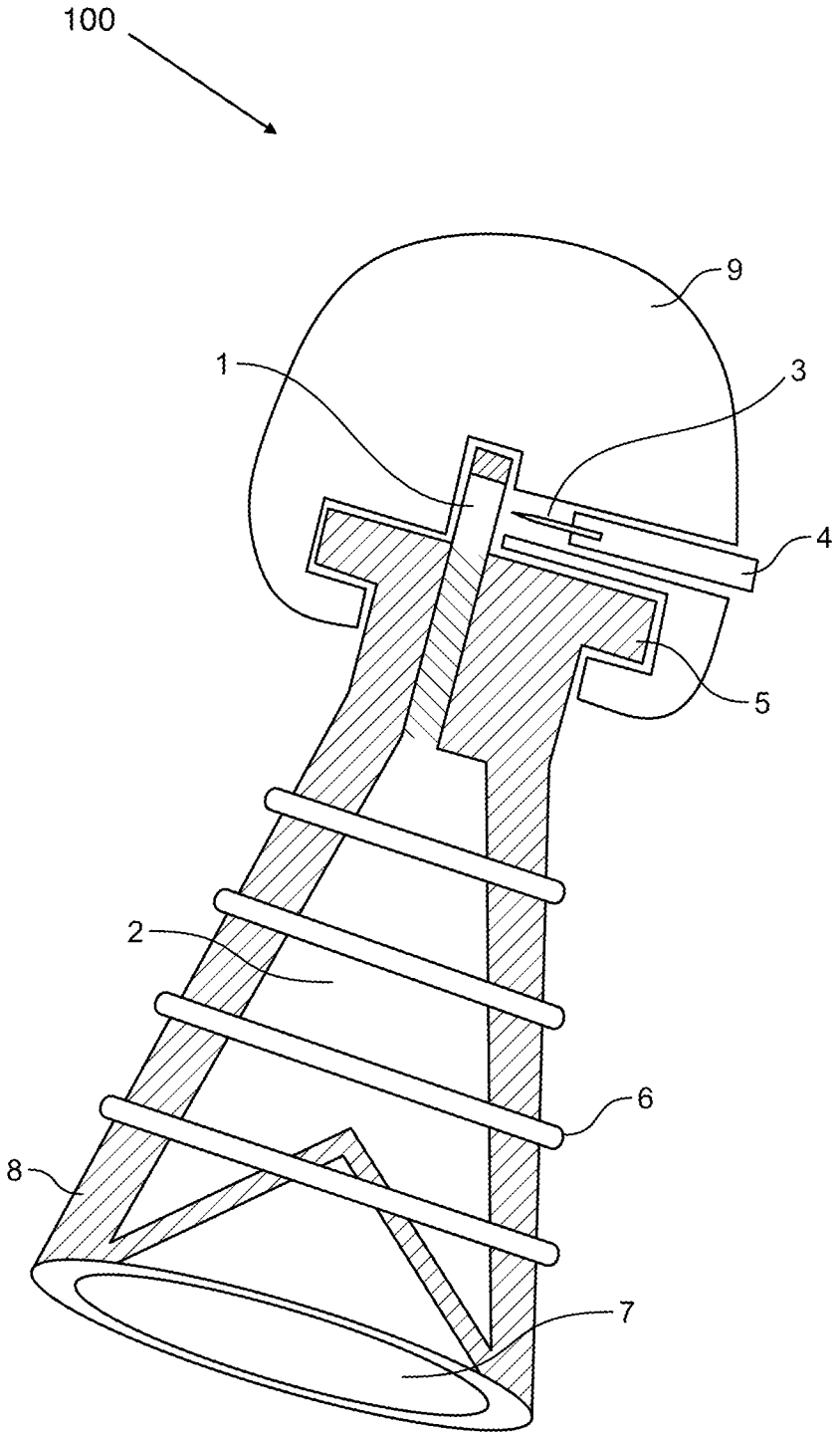
FIG. 1 is a cross sectional view of the self-releasing cork invention.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items" may indicate the presence of only one item or may indicate more items. Thus, the term "set" may be equivalent to "one or more" as used herein.

The present disclosure recognizes the unsolved need for an improved pressurized sealing stopper for the use in bottling applications to time the release of a bottle stopper for bottles containing champagne, wine, and sparkling beverages for celebrations. The stopper has an easy-to-use built-in release mechanism for pressurized bottles of liquids that will reduce the velocity potential of travel when the cork is fully released. The stopper allows for the reduction of the pressure of the bottle prior to full release of the stopper from the bottle neck in pressurized liquid applications allowing the operator to remotely open the bottle from a safe distance.

FIG. 1 is a sectional view of an embodiment of stopper 100 in accordance with the present invention. Stopper 100 has a molded flexible plug-type inflatable bladder 8. Bladder 8 may be continuous and without seams. Bladder 8 may be hollow with an interior chamber 2. The exterior of bladder 8 may have a surface with raised portions such as a plurality of dots, ribs, or protrusions 6.

Figure 4:
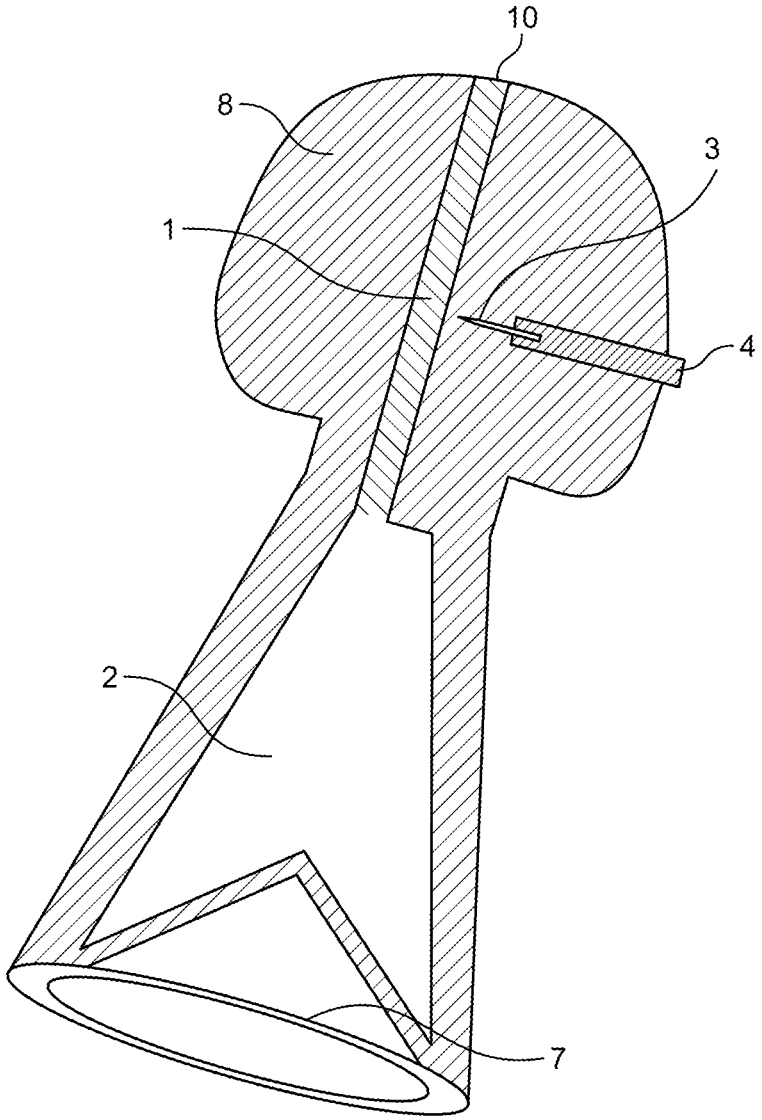
FIG. 4 is a cross sectional view of another embodiment of the self-releasing cork invention.
Figure 5:
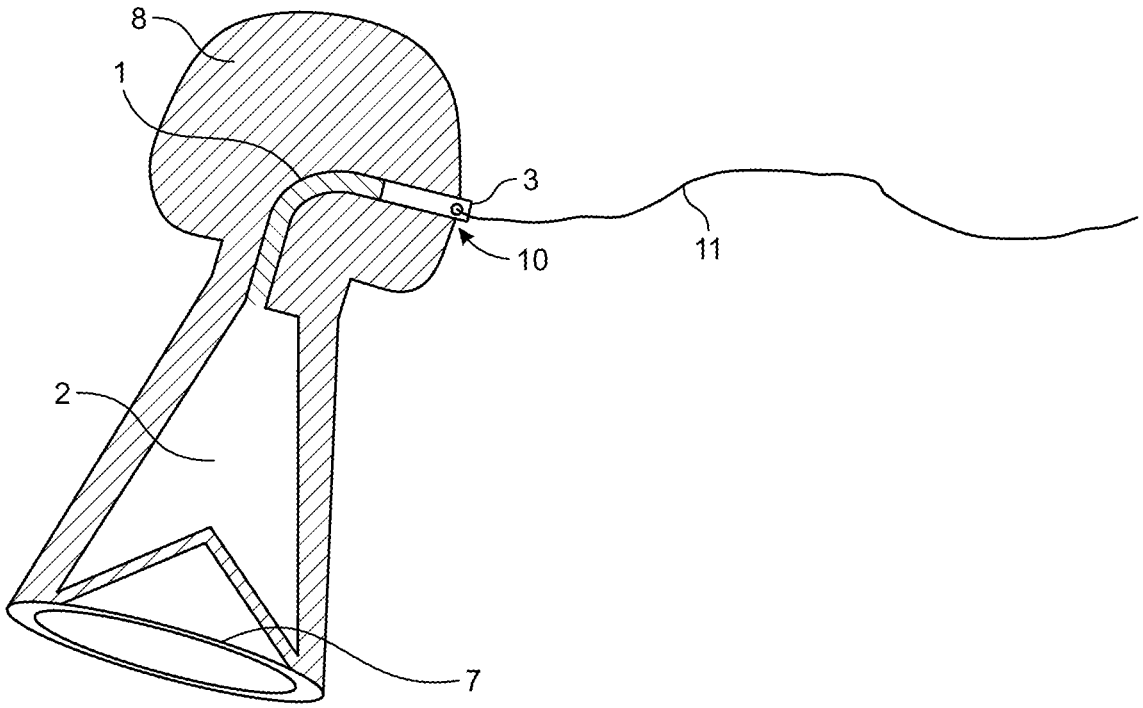
FIG. 5 is a cross sectional view of another embodiment of the self-releasing cork invention.

Bladder 8 may have a V shape or conical bottom portion 7 with multiple angled portions pointing upward and inward to a central point. Conical bottom portion 7 may extend upward from the outer ends of the angled portions into a sidewall. The sidewall has an upward sloping angle that decreases in area until it reaches a circular top portion 5 that is of greater area than an upper top portion of the sidewall but is of less area than conical bottom portion 7. Bladder 8 may be inflated by an inflation tube 1 or filling valve, or plug 10 (as illustrated in FIGS. 4 and 5) that extends through a top outer surface of circular top portion 5 downward into interior chamber 2 such that air or gas may flow through inflation tube 1 into interior chamber 2 from an outside source. In one or more non-limiting embodiments, air or gas may enter manually into interior chamber 2 while an external injection system such as a pump or other device may be used to insert air or another fluid into interior chamber 2. The hole in inflation tube 1 may then be sealed with a plug or release device. In embodiments where inflation tube 1 is a valve, gas may pass through the air inlet into interior chamber 2 while being prevented from leaving interior chamber 2.

A cap assembly 9 may be affixed or otherwise positioned to the top of bladder 8. Cap assembly 9 may have a gas release mechanism for use in stopper 100. The gas release mechanism may utilize a cutting blade or puncturing needle 3 to vent bladder 8. Puncturing needle 3 may be moved towards bladder 8 by a manual or automatic release actuator 4. Actuator 4 may be a button extruding from cap assembly 9 whereby when actuator 4 is moved from a first position to a second position that is closer towards cap assembly 9, puncturing needle 3 also moves in unison in the same direction closer to inflation tube. In further non limiting embodiments, actuator 4 may be a pull string, chain, or rope 11, that extrudes from cap assembly 9, as illustrated in FIG. 5. In this embodiment, actuator 4 may be connected to plug 10, valve, or puncturing needle 3 by a push pull linkage such that when actuator 4 is pulled away from cap assembly 9, plug 10 is removed, or valve is opened or puncturing needle 3 moves closer to inflation tube 1 releasing the gas from interior chamber 2 of bladder 8.

Figure 2:
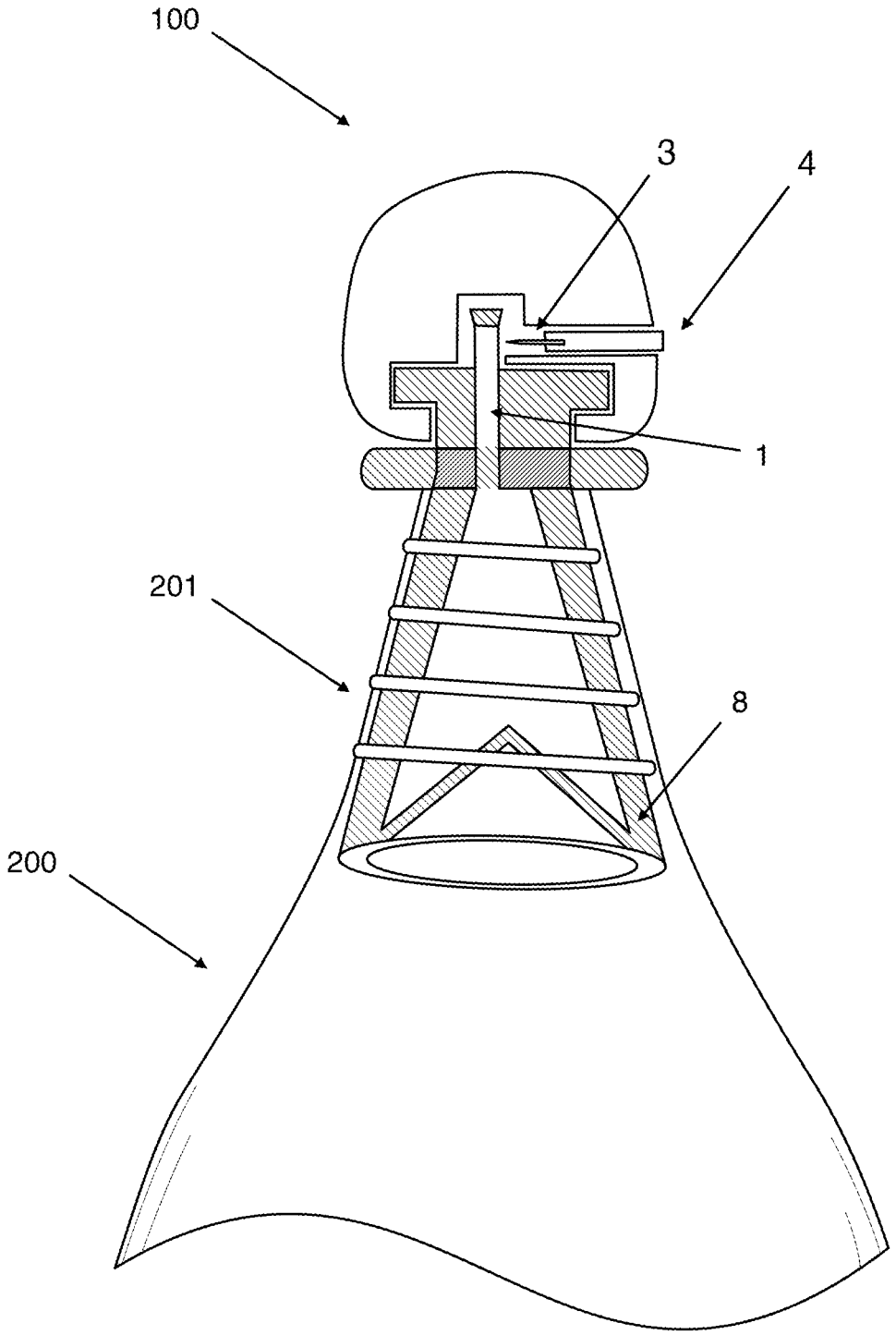
FIG. 2 is a cross-sectional view of the invention inserted in a bottle.

In use, as illustrated in FIG. 2, bladder 8 may be inserted into a neck 201 of a bottle 200 whereby bladder 8 is then inflated and sealed by way of the inflation tube 1. The pressure inside of the bladder 8 will retain stopper 100 until the gas is released through the inflation tube 1. Activation of the release mechanism by actuator 4 will puncture the inflation tube 1 with puncturing needle 3 thereby releasing the gas from interior chamber 2 of bladder 8. The now deflated bladder 8 will be compressed out of the neck by pressure placed on the conical bottom 7 of bladder 8.

Figure 3:
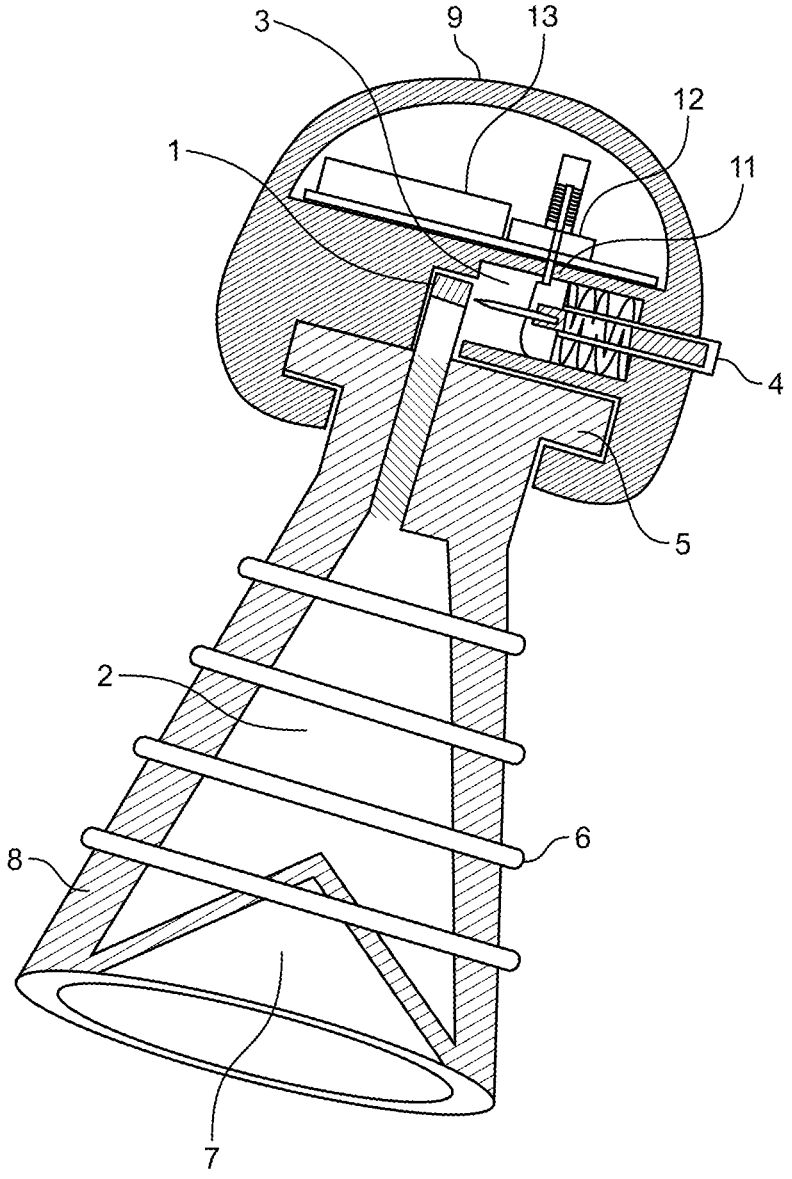
FIG. 3 is a cross-sectional view of the electronically operated variation of the invention.

In further embodiments, cap assembly 9 may have an automatic electromechanical release mechanism 12 used to move puncturing needle 3 towards inflation tube 1 as powered by battery 13, as illustrated in FIG. 3. Electromechanical release mechanism 12 may utilize a control system for remote activation of the release mechanism.

The control system may operate to control the actuation of the other systems including puncturing needle 3. The control system may have a series of computing devices. The control system may be in the form of a circuit board, a memory, or other non-transient storage medium in which computer-readable coded instructions are stored and one or more processors configured to execute the instructions stored in the memory. The control system may have a wireless transmitter, a wireless receiver, and a related computer process executing on the processors.

Computing devices of the control system may be any type of computing device that typically operates under the control of one or more operating systems which control scheduling of tasks and access to system resources. Computing devices may be any computing device capable of executing instructions with sufficient processor power and memory capacity to perform operations of the control system.

The one or more computing devices may be integrated into the control system, while in other non-limiting embodiments, the control system may be a remotely located computing device or server configured to communicate with one or more other control systems. The control system may also include an internet connection, network connection, and/or other wired or wireless means of communication (e.g., LAN, etc.) to interact with other components. The connection allows a user to update, control, send/retrieve information, monitor, or otherwise interact passively or actively with the control system.

The control system may include control circuitry and one or more microprocessors or controllers acting as a servo control mechanism capable of receiving input from sensors and other components, analyzing the input from sensors and other components, and generating an output signal to components. The microprocessors (not shown) may have on-board memory to control the power that is applied to the various systems. The control system may be preprogrammed with any reference values by any combination of hardwiring, software, or firmware to implement various operational modes including but not limited to temperature, light, and humidity values.

The microprocessors in the control system may also monitor the current state of circuitry within the control system to determine the specific mode of operation chosen by the user. Further, such microprocessors that may be part of the control system may receive signals from any of or all systems. Such systems may be notified whether any of the components in the various systems need to be replaced.

Electromechanical release mechanism 12 may include a wireless communication interface, which may be a digital, analog, or mixed-signal circuit to transmit wireless signals indicating user input received from electromechanical release mechanism 12. The wireless signals may be transmitted to a computing device 220 such as a phone, a computer, a wearable device, tablet, a virtual reality system, etc. The wireless communication interface may send and receive data via a wireless network without the need for connecting cables to stopper 100.

Figure 6:
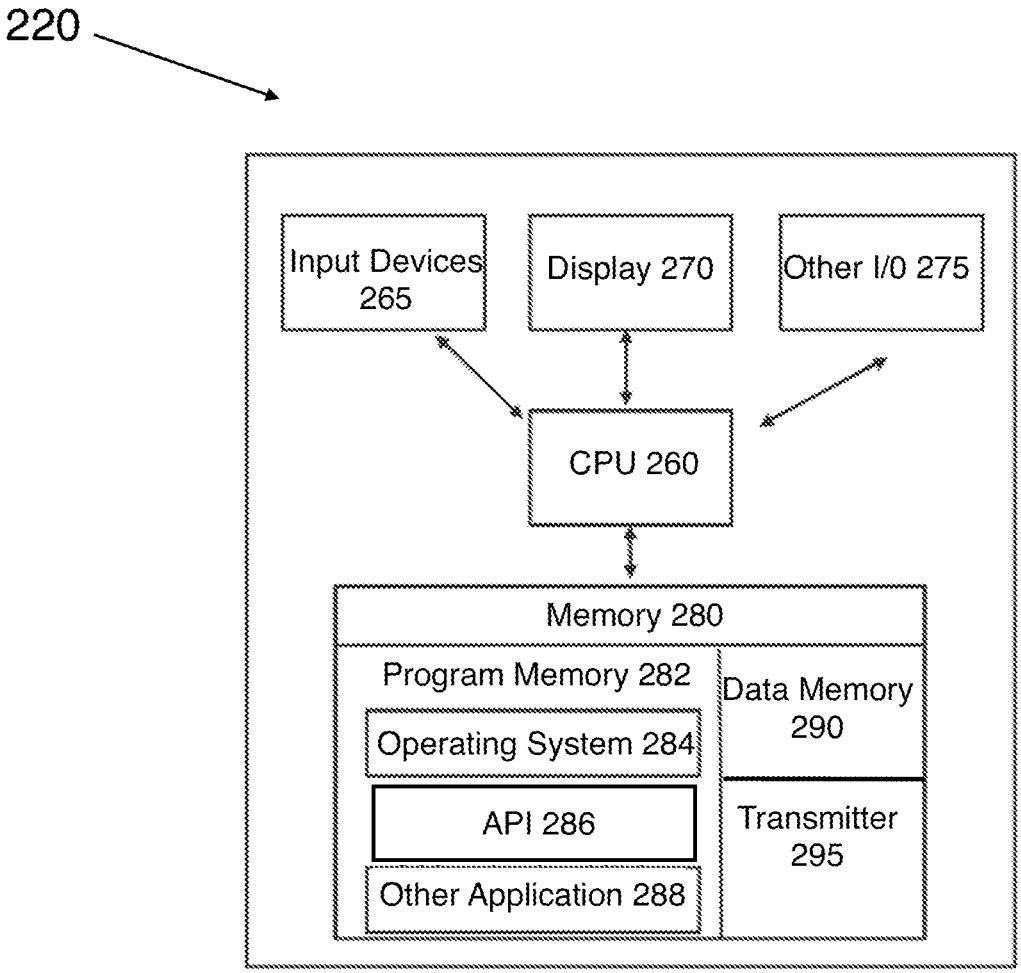
FIG. 6 is a block diagram of the remote computing device.

Turning to FIG. 6, FIG. 6 is a block diagram showing various components of computing device 220. Computing device 220 may comprise a housing for containing one or more hardware components that allow access to edit and query electromechanical release mechanism 12. Computing device 220 may include one or more input devices such as input devices 265 that provide input to a CPU (processor) such as CPU 260 of actions related to user 202. Input devices 265 may be implemented as a keyboard, a touchscreen, a mouse, via voice activation, wearable input device, a 3D camera, a trackball, a microphone, a fingerprint reader, an infrared port, a controller, a remote control, a fax machine, and combinations thereof.

Actions may be initiated by a hardware controller that interprets the signals received from input device 265 and communicates the information to CPU 260 using a communication protocol. CPU 260 may be a single processing unit or multiple processing units in a device or distributed across multiple devices. CPU 260 may be coupled to other hardware devices, such as one or more memory devices with the use of a bus, such as a PCI bus or SCSI bus. CPU 260 may communicate with a hardware controller for devices, such as for a display 270. Display 270 may be used to display text and graphics. In some examples, display 270 provides graphical and textual visual feedback to a user.

In one or more embodiments, display 270 may include an input device 265 as part of display 270, such as when input device 265 is a touchscreen or is equipped with an eye direction monitoring system. In some implementations, display 270 is separate from input device 265. Examples of display 270 include but are not limited to: an LCD display screen or an LED.

Other I/O devices such as I/O devices 275 may also be coupled to the processor, such as a network card, video card, audio card, USB, FireWire or other external device, camera, printer, speakers, CD-ROM drive, DVD drive, disk drive, or Blu-Ray device. In further non-limiting embodiments, a display 270 may be used as an output device, such as, but not limited to, a computer monitor, a speaker, a television, a smart phone, a fax machine, a printer, or combinations thereof.

CPU 260 may have access to a memory such as memory 280. Memory 280 may include one or more of various hardware devices for volatile and non-volatile storage and may include both read-only and writable memory. For example, memory 280 may comprise random access memory (RAM), CPU registers, read-only memory (ROM), and writable non-volatile memory, such as flash memory, hard drives, floppy disks, CDs, DVDs, magnetic storage devices, tape drives, device buffers, and so forth. Memory 280 may be a non-transitory memory.

Memory 280 may include program memory such as program memory 282 capable of storing programs and software, including an operating system, such as operating system 284. Memory 280 may further include an application and application programing interface (API), such as application 286, and other computerized programs or application programs such as application programs 288. Memory 280 may also include data memory such as data memory 290 that may include database query results, configuration data, settings, user options, user preferences, or other types of data, which may be provided to program memory 282 or any element of user computing device 220.

Computing device 220 may have a transmitter, such as transmitter 295. Transmitter 295 may have a wired or wireless connection and may comprise a multi-band cellular transmitter to connect to the server over 2G/3G/4G/5G cellular networks. Other embodiments may also utilize Near Field Communication (NFC), Bluetooth, or another method to communicate information.

Figure 7:
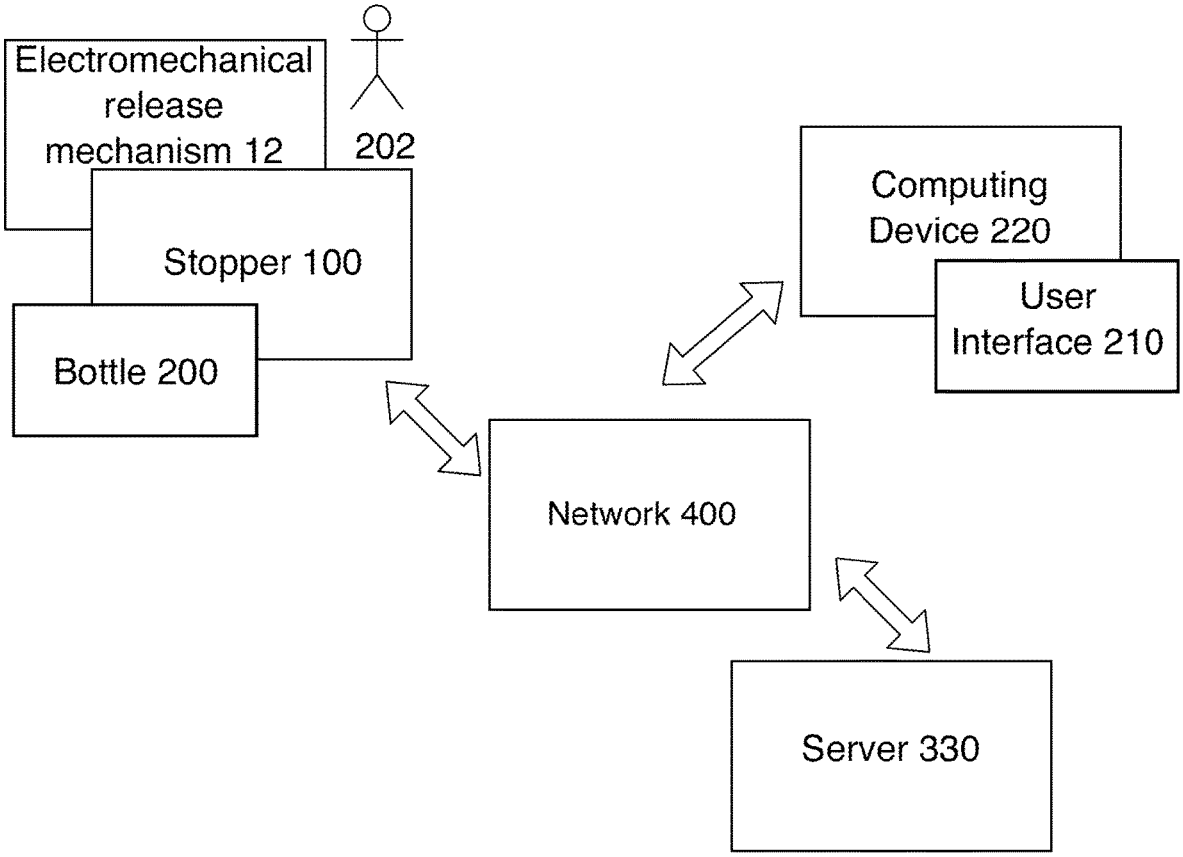
FIG. 7 is a block diagram of a connected network for the self-releasing cork.

As illustrated in FIG. 7, a user 202 may access a user interface, such as user interface 210 using computing device 220. User interface 210 may have a plurality of buttons or icons that are selectable to perform particular processes in response to the selections. User interface 210 may have conventional GUI interface devices such as a title bar, toolbars, pull-down menus, tabs, scroll bars, context help, dialog boxes, operating buttons (icons) and status bar the user 202 navigates throughout the display.

In some embodiments, stopper 100 and computing device 220 may be in communication with one or more servers, such as server 330 or one or more networks such as network 400. Server 330 may be located at a data center, or any other location suitable for providing service to network 400 whereby server 330 may be in one central location or in many different locations in multiple arrangements. Server 330 may comprise a database server such as MySQL® or Maria DB® server. Server 330 may have an attached data storage system storing software applications and data. Server 330 may have a number of modules that provide various functions related to stopper 100. Modules may be in the form of software or computer programs that interact with the operating system of server 330 whereby data collected in databases as instruction-based expressions of components and/or processes may be processed by one or more processors within server 330 or as well as in conjunction with execution of one or more other computer programs. Modules may be configured to receive commands or requests from interactive stopper 100, computing device 220, server 330, and outside connected devices over network 400. Server 330 may comprise components, subsystems, and modules to support one or more management services for stopper 100.

In one or more non-limiting embodiments, network 400 may include a local area network (LAN), such as a company Intranet, a metropolitan area network (MAN), or a wide area network (WAN), such as the Internet or World Wide Web. Network 400 may be a private network or a public network, or a combination thereof. Network 400 may be any type of network known in the art, including a telecommunications network, a wireless network (including Wi-Fi), and a wireline network. Network 400 may include mobile telephone networks utilizing any protocol or protocols used to communicate among mobile digital user computing devices (e.g., computing device 220), such as GSM, GPRS, UMTS, AMPS, TDMA, or CDMA. In one or more non-limiting embodiments, different types of data may be transmitted via network 400 via different protocols. In alternative embodiments, computing devices 220 may act as standalone devices or they may operate as peer machines in a peer-to-peer (or distributed) network environment.

Network 400 may further include a system of terminals, gateways, and routers. Network 400 may employ one or more cellular access technologies including 2nd (2G), 3rd (3G), 4th (4G), 5th (5G), LTE, Global System for Mobile communication (GSM), General Packet Radio Services (GPRS), Enhanced Data GSM Environment (EDGE), and other access technologies that may provide for broader coverage between user computing devices if, for instance, they are in a remote location not accessible by other networks.

User interface 210 on computing device 220 may display statuses for stoppers 100 that are registered or otherwise in communication with computing device 220. For instance, user interface 210 may display information to user 202 logged in to an account that includes three stoppers 100 for three different types of drinks. A status for each stopper 100 is displayed on a list. In one embodiment, the list may be a dynamic list in which the stoppers 100 are ordered according to the name of the drink.

User interface 210 may have an adjustable timer component for stopper 100 to operate in synchronization whereby the timer component may enable input from user 202 for electromechanical release mechanism 12 to delay state changes when puncturing inflation tube 1. Thus, activation may be delayed for an amount of time by user 202 through user interface 210. The amount of time for the delay may be predetermined, at random, or by the input obtained from user 202 such as based on the amount of time user 202 selects a selectable manual button on user interface 210 to open the bottles. User interface 210 may allow user 202 to open bottles only at certain times of the day. For instance, user interface 210 may present to user 202 options to switch the state of electromechanical release mechanism 12 to operate at preprogrammed times, at times determined according to a random pattern, or any other variation. User interface 210 may present one or more clocks that provide an understanding of time of day, day, month, or year, that bottles may open.

The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A stopper for a neck of a bottle, the stopper comprising:

an inflatable bladder that is collapsible, the inflatable bladder with an interior chamber;

an inflation tube in fluid communication with the interior chamber wherein the inflation tube extends above the inflatable bladder; and a cap assembly positioned above the inflatable bladder wherein the inflation tube extends into the cap assembly, the cap assembly having a release mechanism to release gas from the inflatable bladder, wherein the release mechanism comprises a needle or blade to puncture the inflation tube and an actuator connected to the needle or blade wherein the actuator extends from a cavity at a side of the cap assembly wherein when the actuator moves from a first position to a second position the needle or blade moves from a first position to a second position to puncture a side of the inflation tube, wherein the inflatable bladder has a flanged top portion a neck portion and conical bottom portion wherein the flanged top portion is of greater area than the neck portion but is of less area than the conical bottom portion, wherein the cap assembly extends over the flanged top portion.

2. The stopper of claim 1, wherein the inflation tube is sealed with a plug.

3. The stopper of claim 1, wherein the inflatable bladder has one or ribs or protrusions on an exterior of the inflatable bladder that increase in size in a downward direction.

4. A stopper for a neck of a bottle, the stopper comprising:

an inflatable bladder that is collapsible, the inflatable bladder with an interior chamber;

an inflation tube in fluid communication with the interior chamber wherein the inflation tube extends above the inflatable bladder; and a cap assembly positioned above the inflatable bladder wherein the inflation tube extends into the cap assembly, the cap assembly having a release mechanism to release gas from the inflatable bladder, wherein the release mechanism comprises a needle or blade to puncture the inflation tube and an actuator connected to the needle or blade wherein the actuator extends from a cavity at a side of the cap assembly wherein when the actuator moves from a first position to a second position the needle or blade moves from a first position to a second position to puncture a side of the inflation tube, wherein the inflatable bladder has a closed v shaped bottom surface with segments angled upwards toward one another wherein when the actuator is in the second position the closed v shaped bottom surface is not pierced.

* * * * *